US005572593A

United States Patent [19]

Nejime et al.

[11] Patent Number: 5,572,593

[45] Date of Patent: Nov. 5, 1996

[54] METHOD AND APPARATUS FOR DETECTING AND EXTENDING TEMPORAL GAPS IN SPEECH SIGNAL AND APPLIANCES USING THE SAME

[75] Inventors: Yoshito Nejime; Hiroshi Ikeda, both of Hachioji; Yukio Kumagai, Tokorozawa, all of Japan

[73] Assignee: Hitachi, Ltd., Tokyo, Japan

[21] Appl. No.: 80,101

[22] Filed: Jun. 23, 1993

[30] Foreign Application Priority Data

Jun. 25, 1992 [JP] Japan ..... 4-167228

[51] Int. Cl.[6] ..... H04R 25/00

[52] U.S. Cl. ..... 381/68; 395/2.8; 395/2.24

[58] Field of Search ..... 395/2.19, 2.23, 395/2.24, 2.57, 2.62; 381/30, 34, 35, 68, 68.2, 68.4

[56] References Cited

U.S. PATENT DOCUMENTS 4,331,837 5/1982 Soumagne ..... 395/2.24

5,278,910 1/1994 Suzuki et al. ..... 381/41

5,305,420 4/1994 Nakamura et al. ..... 395/2.8

*Primary Examiner*—Allen R. MacDonald

*Assistant Examiner*—Thomas J. Onka

*Attorney, Agent, or Firm*—Antonelli, Terry, Stout & Kraus

[57] ABSTRACT

A method and an apparatus for detecting and extending controllably temporal gaps in a speech in dependence on power thereof for the purpose of aiding an auditory sense organ. A temporal gap detecting facility for detecting temporal gaps in the input speech signal and a temporal gap extension facility for extending the temporal gap by repetitive addition thereof are provided, wherein the number of repetition is selected to be proportional to power of the input speech signal at a time point immediately preceding to the temporal gap. Alternatively, the temporal gap extension facility adds repeatedly to the temporal gap a part thereof exclusive of start and end parts.

37 Claims, 8 Drawing Sheets

METHOD AND APPARATUS FOR DETECTING AND EXTENDING TEMPORAL GAPS IN SPEECH SIGNAL AND APPLIANCES USING THE SAME

BACKGROUND OF THE INVENTION

The present invention relates generally to a speech signal processing adopted in hearing aids and the like for aiding a weakened auditory sense organ and more particularly to a method of detecting and extending temporal gaps in a speech signal, an apparatus for carrying out the same, and appliances to which the method and the apparatus are applied.

In hearing aids for assisting or aiding the function of the auditory sense organ of hearing-impaired listeners, there have been used mainly analogue type hearing aids in which conventional analogue circuits are employed for processing the amplitude and frequency characteristics of the speech signals. In recent years, however, studies and developments of digital type hearing aids based on digital signal processing technology are energetically carried on. The trend of such studies and developments is reported in detail, for example, in "TREND OF HEARING AIDS UP TO RECENTLY": The Periodical of The Acoustical Society of Japan, Vol. 45, No. 7, (1989), pp. 549–555, and other literatures. The speech signal processing adopted in the digital hearing aid is performed with the aid of a digital signal processor (DSP).

The content of the digital processing to this end is described in the form of a program and stored in a memory. For this reason, alteration or modification of the content of the processing is much facilitated when compared with the conventional analogue type hearing aid, because it can be accomplished simply by altering the program stored in the memory. To say in another way, the digital type hearing aids can easily be adjusted so as to maximize or optimize the clearness of speech to the individual hearing-impaired listeners. In order that the digital type hearing aids replace the analogue type hearing aids, it is a prerequisite that all processings involved be completed with the shortest possible time lag that can not be perceived by the listener or user.

With the speech signal processing adopted in the hearing aids, it is intended to make up for degradation in the frequency resolution, temporal resolution, spectrum discrimination, sound image synthesization and the like abilities of the people with hearing loss. The processings for these purposes are discussed in detail, for example, in "DIGITAL HEARING AID HAVING SPEECH FEATURE EXTRACTING FUNCTION": The Periodical of The Acoustical Society of Japan, Vol, 43, No. 5, (1987), pp. 356–361. Among them, a method of extending temporal gaps (quiescent gap) in a speech signal can be considered as one of the processings to make up for degradation in the temporal resolution capability of the auditory sense organ. According to this temporal gap extending method, temporal gaps or quiescent intervals of a very short duration are inserted between vowels and consonants in a speech signal with inter-word temporal gaps or quiescent intervals being extended for suppressing a temporal masking phenomenon elucidated below. This method is certainly effective for mitigating the temporal masking phenomenon for the hearing-impaired listeners and at the same time for protecting the user against deterioration of the ability for audibly understanding or following the speech.

In case of the hearing aids for the sensory-neural (hearing) impairments who are found in many of the aged persons, it is desirable not only to process the speech frequency characteristic for aiding the frequency resolution capability of the user but also to perform simultaneously the processing for compensating for deterioration in the temporal resolution capability in order to enhance the clearness of speech by processing the speech signal. As a concrete example of the deterioration in the temporal resolution capability, there may be mentioned a so-called "temporal masking" phenomenon that a feeble sound component which immediately follows a strong sound component can not auditorily be discerned due to the masking effect of the latter. Under the circumstances, the hearing impairents often fall into such uncomfortable situation that "although the sound can certainly be sensed, content of the speech can not be understood". This phenomenon is discussed in detail, for example, in "INFLUENCE OF TEMPORAL MASKING TO PERCEPTION OF VOICELESS SOUNDS OF PLOSIVE": Technical Studies Reports of The Institute of Electronics, Information and Communication Engineers of Japan (SP90-97) and other literatures.

In the studies of the technology concerning the detection and extension of the temporal gaps (quiescent intervals)in association with the application to hearing aids, there have heretofore been adopted a method of examining or analyzing the waveform of speech signals display on a cathode ray tube and a method of processing only the speech data of high S/N ratio simply by using a threshold value in the experiments at the level of the laboratory studies.

In order to perform the processing for extending the temporal gaps, it is required to detect the temporal gaps in the speech waves in time domain. In this conjunction, it is noted that the speech waveform lacks steadiness under the influence of background noise or other factors. Consequently, there arises for the detection of the temporal gaps a difficulty that such algorithms and parameters have to be adopted which are less susceptible to the influence of variations in the speech level brought about by noise components.

However, the methods known heretofore are not in the position to extend the temporal gaps dynamically on a real-time basis in dependence on the input speech signal, even though it can provide a simple procedure for detecting the temporal gaps. Such being the circumstance, it is safe to say that there has been proposed no practical means for solving the problems mentioned above which are encountered in the use of the hearing aids.

SUMMARY OF THE INVENTION

It is therefore an object of the present invention to provide a method and an apparatus for detecting and extending temporal gaps in a speech signal for the purpose of aiding the weakened auditory sense organ.

More specifically, it is an object of the present invention to provide a temporal gap detection/extension method as well as an apparatus for carrying out the same, which method and apparatus are capable of controlling the rate of extension of the temporal gap in dependence on the power of the speech signal and which are less susceptible to the influence of noise components.

For achieving the above and other objects which will become apparent as description proceeds, it is proposed according to an aspect of the present invention to detect temporal gaps from an input speech signal and extend the detected temporal gaps, wherein the degree or rate of the extension is controlled in dependence on the power of the speech signal for the purpose of suppressing the temporal masking phenomenon instead of inserting the temporal gaps each of a constant duration. In conjunction with the detection of the temporal gap, measures are taken for making the detection less susceptible to the background noise, while the power of the speech signal is detected to be utilized as a parameter for determining the rate of extension of the temporal gap to thereby aid the auditory sense organ optimally and most comfortably.

Thus, there is provided according to the invention an apparatus for detecting and extending temporal gaps in speech for the purpose of aiding an auditory sense organ by processing waveforms of an input speech signal, which apparatus comprises a temporal gap detecting unit for detecting a temporal gap in an input speech signal, and a temporal gap extension unit for adding repeatedly a signal of the temporal gap detected by the temporal gap detecting unit to the temporal gap in the input speech signal, wherein the number of repetitive additions of the detected temporal gap is selected to be proportional to the power of the input speech signal at a time point immediately preceding to the detected temporal gap. In another mode for carrying out the invention, the temporal gap extension apparatus may be so implemented as to add repeatedly a portion of the temporal gap at a given time point in the duration thereof inclusive of start and end time points.

Further, there is provided according to the invention a method of detecting and extending temporal gaps in speech for the purpose of aiding an auditory sense organ by processing waveforms of an input speech signal, which method comprises a temporal gap detecting step for detecting a temporal gap in an input speech signal, and a temporal gap extension step for adding repeatedly a signal of the temporal gap detected in the temporal gap detecting step to the temporal gap in the input speech signal, wherein the number of the repetitive additions of the detected temporal gap is selected to be proportional to the power of the input speech signal at a time point immediately preceding to the detected temporal gap. In another mode for carrying out the invention, a portion of the temporal gap at a given time point in the duration thereof inclusive of start and end time points may be repeatedly added in the temporal gap extension step.

More specifically, it is proposed according to a first aspect of the invention to provide a facility for storing or recording in a memory a speech waveform which is to undergo the temporal gap extension processing and detecting simultaneously an envelope signal of the speech signal waveform, a facility for detecting a maximum value and a minimum value of the envelope signal, and a facility for determining a threshold value for the detection of the temporal gap on the basis of the above-mentioned maximum and minimum values, wherein upon reproduction of the speech signal as recorded, a period or interval in which the envelope signal becomes lower than the threshold level is detected as a temporal gap.

According to a second aspect of the invention, it is proposed to provide a facility for detecting an envelope signal of a speech signal waveform which is to undergo the temporal gap extension processing, and a facility for deriving a differential signal of the envelope signal, wherein a temporal interval in which the differential signal changes from a negative (minus) value (polarity) to a positive (plus) value (polarity) is detected as a temporal gap and wherein the rate at which the temporal gap is to be extended is determined in proportional dependence on a peak value of the differential signal.

Additionally, according to a third aspect of the invention, it is taught to provide a facility for detecting an envelope signal of a speech signal waveform which is to undergo the temporal gap extension processing, a facility for delaying the envelope signal for a predetermined time, and an OFF neuron circuit for detecting rising-up and falling of the envelope signal on the basis of difference between an integral of the envelope signal and that of the delayed envelope signal, wherein a time interval intervening between the detection of the falling of the envelope signal by the OFF neuron circuit and the detection of the succeeding rising-up thereof is decided to be a temporal gap, and wherein the rate at which the temporal gap is to be extended is determined in proportional dependence on the outputs of the OFF neuron circuit generated upon detection of the rising-up and the falling of the envelope signal.

With the arrangement according to the first aspect of the invention in which the envelope signal of the input speech signal is detected and both the envelope signal and the input speech signal are simultaneously recorded on a recording medium such as a memory or the like, detection of the envelope signal upon reproduction of the speech signal can be spared, while the extension of the temporal gap can be performed on a real-time basis, to an advantage. Further, because the threshold value for detecting the temporal gaps is determined on the basis of the maximum value and the minimum value of the recorded envelope signal, the threshold level can be set appropriately in dependence on variation in the level of the speech signal subjected to the processing, whereby detection of the temporal gap which is less susceptible to the influence of level variation of the speech signal due to noise components can be achieved, to another advantage.

By virtue of the arrangement according to the second aspect of the invention in which the rising-up as well as the falling of the speech signal is detected on the basis of the differential signal of the envelope signal, the temporal gaps can positively be detected even when the input speech signal contains a steady noise component. Further, because the rate of extension of the temporal gap is determined in proportion to the peak value of the differential signal, the temporal gap succeeding to a steep falling of the speech signal is extended at a high rate while the temporal gap succeeding to a gentle falling is extended at a low rate. As a result, the temporal gap occurring after a voice component of high power which is likely to give birth to the temporal masking phenomenon is extended at a high rate. Thus, there can be realized the temporal gap extension in conformance with the power or energy of the input speech, which is profitably suited for suppression of the temporal masking phenomenon.

With the arrangement according to the third aspect of the invention in which difference between the envelope signal and the delayed envelope signal is determined by the OFF neuron circuit for detecting the rising-up and the falling in the input speech signal, the influence of a steady noise component, if contained in the input speech signal, can be suppressed effectively. Further, because the output of the OFF neuron circuit is in proportion to the magnitude of the envelope signal, determination of the rate of extension of the temporal gap in proportional dependence on the output of the OFF neuron circuit makes it possible to extend the temporal gap in conformance with the power of the speech signal.

DESCRIPTION OF THE PREFERRED EMBODIMENTS

Now, the present invention will be described in detail in conjunction with the preferred or exemplary embodiments thereof by reference to the drawings.

Figure 1:
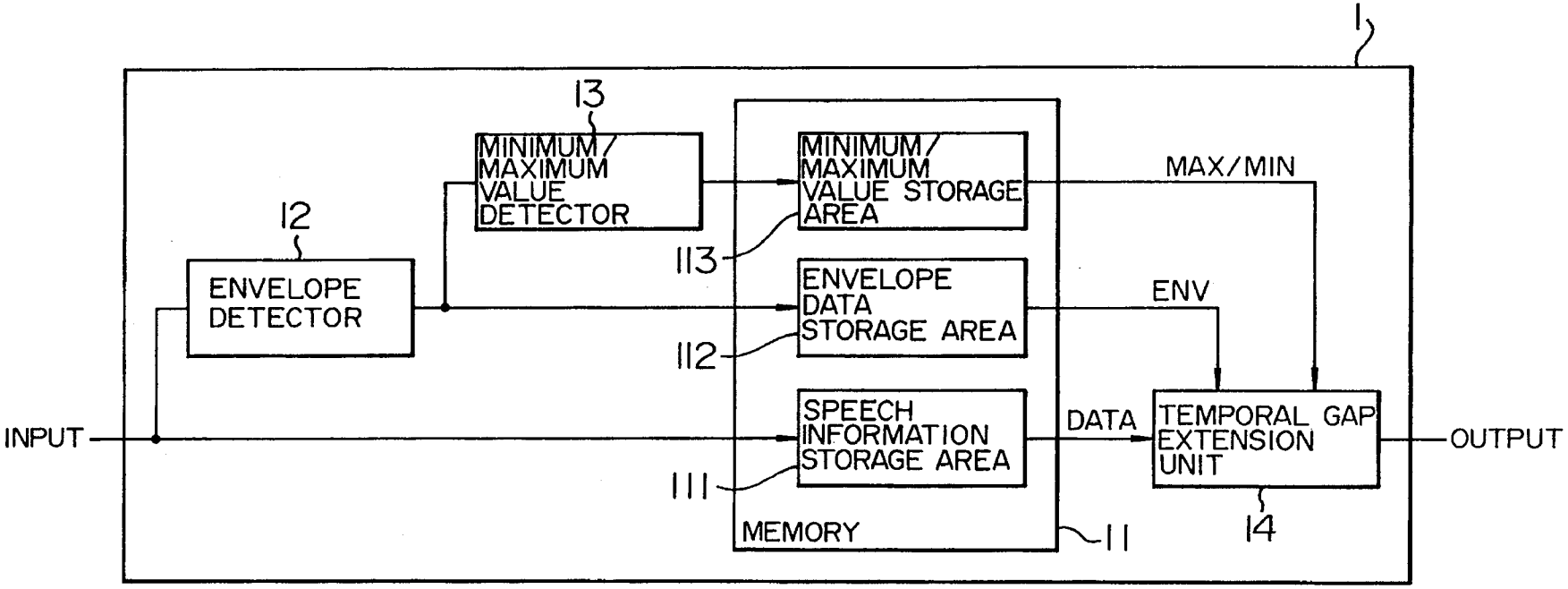
FIG. 1 is a block diagram showing a configuration of a temporal gap detection/extension apparatus according to a first embodiment of the present invention.

FIG. 1 shows in a block diagram a circuit configuration of a temporal gap detection/extension apparatus 1 according to a first embodiment of the invention in which an envelope-threshold processing technique taught by the invention is adopted. At first, operation of this temporal gap detection/extension apparatus 1 will briefly be described below.

Referring to FIG. 1, an input speech signal is converted into a digital signal by an analogue-to-digital (A/D) converter (not shown). The digital input speech signal resulting from the A/D conversion is stored in a speech information storage area 111 of a memory 11 and at the same time applied to the input of an envelope detecting circuit 12 which is designed to detect an envelope of the input speech signal. The detected envelope signal is stored in an envelope data storage area 112 of the memory 11 and at the same time supplied to an envelope maximum/minimum value detecting circuit 13 which serves for detecting maximum and minimum values of the envelope signal. The maximum and minimum values as detected are then stored in an maximum/minimum value storage area 113 of the memory 11. For reproducing the speech information stored in the memory 11, the contents of the speech information storage area 111, the envelope data storage area 112 and the maximum/minimum storage area 113 are inputted to the temporal gap extension unit 14 which is designed to detect temporal gaps (quiescent gaps) existing in the speech signal DATA on the basis of the envelope signal ENV, the maximum value MAX and the minimum value MIN thereof, extend the temporal gaps and output the speech having the temporal gaps extended.

More specifically, the memory 11 for storing the data or information is partitioned into three areas. The speech signal as inputted is stored in the speech information storage area 111 of the memory 11 and at the same time inputted to the envelope detecting circuit 12. The envelope data ENV as detected by the enveloped detecting circuit 12 is stored in the envelope data storage area 112 of the memory 11. Additionally, the envelope data ENV is inputted to the maximum/minimum value detecting circuit 13 for detecting the maximum value MAX and the minimum value MIN of the detected envelope. The maximum value MAX and the minimum value MIN as detected are then stored in the maximum/minimum value storage area 113 of the memory 11. Detection of the envelope can be realized, for example, by arithmetically determining mean values of the input speech signal over a succession of predetermined time intervals. As a result, there are stored in the memory 11 the speech information inputted within a predetermined time period, the envelope data temporally corresponding to the speech information and the maximum and minimum values of the envelope within the predetermined time. Upon reproduction of the speech from the data or contents stored in the memory 11, the speech information DATA stored in the speech information storage area 111 of the memory 11, the envelope data ENV stored in the envelope data storage area 112 of the memory 11 as well as the maximum value MAX and the minimum value MIN of the envelope stored in the maximum/minimum value storage area 113 of the memory 11 are read out and inputted to the temporal gap extending unit 14, which detects the temporal gaps or gaps contained in the speech information fetched from the speech information storage area 111 by making use of the envelope data fetched from the envelope data storage area 112 together with the maximum and minimum values of the envelope supplied from the maximum/minimum value storage area 113. The temporal gaps as detected are then extended by the temporal gap extending unit 14, whereby the speech having the temporal gaps extended is outputted from the apparatus 1.

Figure 2:
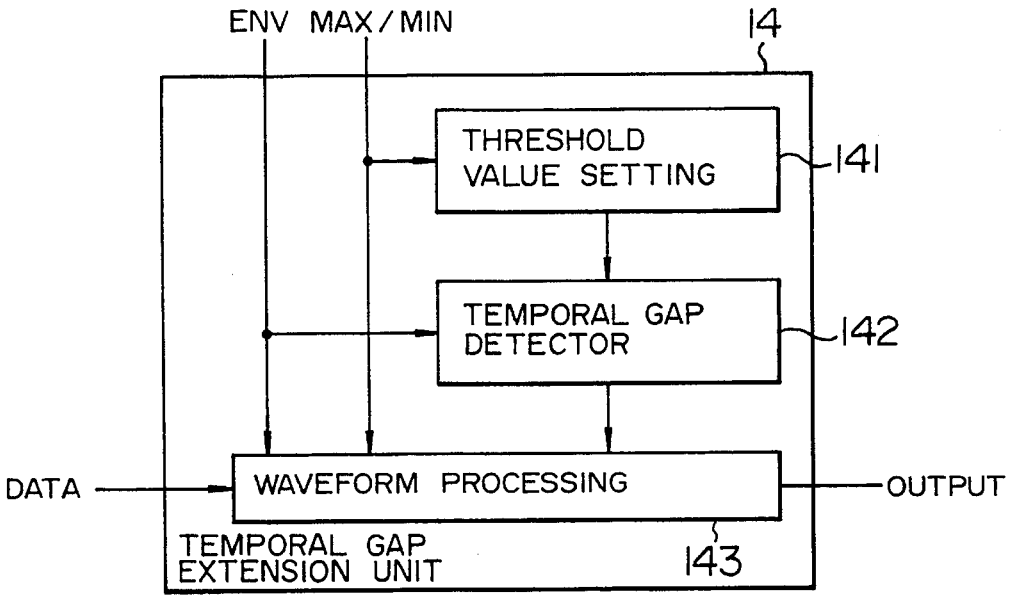
FIG. 2 is a block diagram showing in detail a configuration of a temporal gap extension unit of the apparatus shown in FIG. 1.

FIG. 2 shows in detail a configuration of the temporal gap extension unit 14. As can be seen in the figure, the temporal gap extension circuit 14 includes a threshold value setting circuit 141 which sets a threshold level T on the basis of the maximum value MAX and the minimum value MIN of the envelope supplied from the maximum/minimum value storage area 113 of the memory 11. More specifically, the threshold level T is set at a given value lying between the maximum value MAX and the minimum value MIN of the envelope supplied from the maximum/minimum value storage area 113 of the memory 11. A temporal gap detecting circuit 142 performs comparison of the envelope data ENV supplied from the envelope data storage area 112 with the threshold value T to detect an interval or period during which the envelope data values remain smaller than the threshold value T as the temporal gap. (More specifically, a period during which the envelope data value remains continuously smaller than the preset threshold value is detected, and when the detected period is longer than a preset shortest temporal gap, that period is then detected as the temporal gap.) Subsequently, a speech wave from processing circuit 143 sets a period corresponding to the temporal gap detected by the temporal gap detecting circuit 142 for the speech information supplied from the speech information storage means 111 of the memory 11. Upon outputting of the speech information, the speech information lying outside of the temporal gap is outputted as it is, while voice information falling within the temporal gap is repeatedly outputted. In this conjunction, it should be mentioned that the number of the repetition is set to a value which is proportional to a value of the envelope of the speech signal at a time point which immediately precedes to the temporal gap or alternatively the maximum value of the envelope supplied from the maximum/minimum storage area 113 of the memory 11. However, the number of repetition is not limited to an integer but a real value such as 1.2 or 3.4 can be selected. In this way, extension of the temporal gap can be realized in dependence on magnitude or amplitude of the speech signal.

Figure 3:
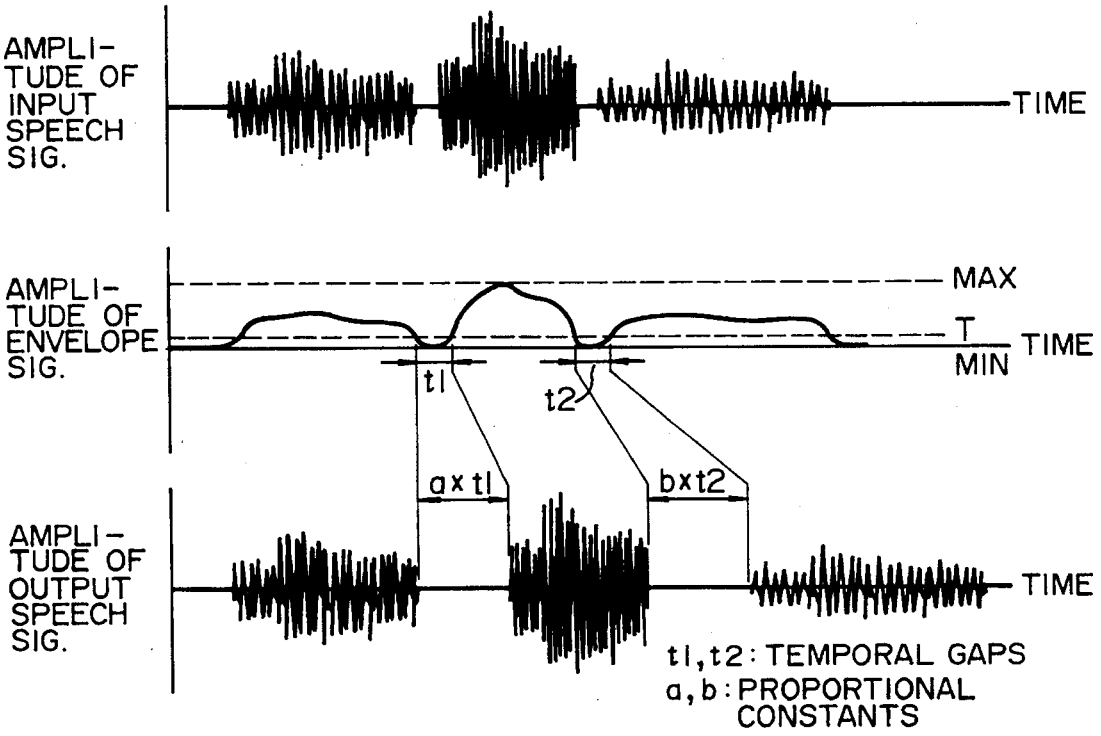
FIG. 3 is a waveform diagram for illustrating a processing for extending a temporal gap through a threshold processing of an envelope signal derived from an input speech signal.

FIG. 3 shows, by way of example, waveforms for illustrating the processing for extending the temporal gap. As can be seen from this figure, there exist two periods or intervals t1 and t2 during which the amplitude of the envelope signal becomes smaller than the threshold value T, wherein these intervals t1 and t2 are detected as the temporal gaps and extended by factors a and b, respectively. The values of the factors a and b are determined on the basis of the envelope amplitude values at time points immediately preceding to the temporal gaps t1 and t2, respectively. Since the threshold value T is constantly set at a value intermediate between the maximum value MAX and the minimum value MIN of the envelope signal stored in the memory 11, the period during which the amplitude of the envelope signal remains smaller than the threshold value T can be detected as the temporal gap without fail. According to the teachings of the invention incarnated in the instant embodiment that upon recording of the speech information, the envelope information and the parameters for determining the threshold value are detected and recorded, overhead involved in the signal processing for the speech reproduction can significantly be diminished, which is very advantageous for the case where other processing requiring a lot of time such as, for example, processing of the speech frequency characteristic is to be performed in parallel on a real-time basis upon reproduction of the speech.

It has been assumed in the above description that the input speech signal is digitized in precedence to the temporal gap extension processing. However, it goes without saying that the invention can equally be carried out in such a manner in which the input analogue speech signal is intactly inputted to an envelope detecting circuit which is designed for detecting the envelope of the input speech signal through analogue processing with the maximum value and the minimum value of the envelope as detected being digitized for storage in a memory, while the input speech information and the envelope data as detected are recorded on a recording medium in the form of analogue quantities, to detect the temporal gap and process the speech waveforms for extending the temporal gap by resorting to an appropriate analogue processing.

Figure 4:
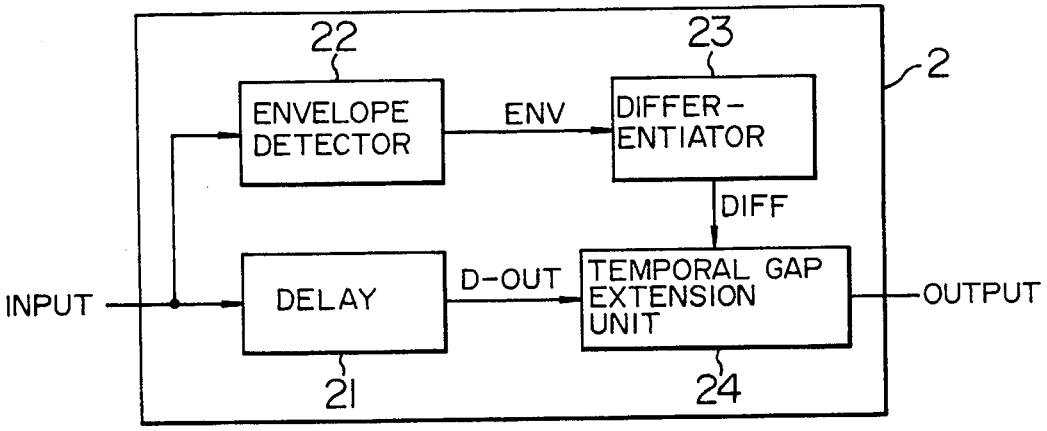
FIG. 4 is a block diagram showing a configuration of a temporal gap detection/extension apparatus according to a second embodiment of the invention signal.

FIG. 4 shows in a block diagram a configuration of the temporal gap detection/extension apparatus according to a second embodiment of the invention in which a differential signal of the envelope is utilized.

Figure 5A:
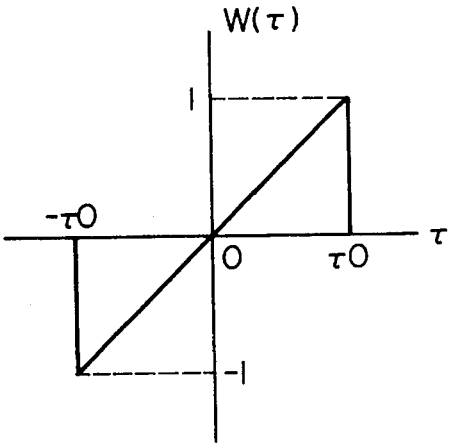
FIG. 5A is a view for illustrating a method of performing convolution (Faltung) integration on envelope data with a window function to derive differential values of the envelope.

Referring to FIG. 4, the input speech signal is converted to a digital signal through an A/D converter (not shown). The digital speech signal resulting from the A/D conversion is inputted to an envelope detecting circuit 22 and at the same time stored in a memory (not shown) incorporated in a delay circuit 21. Envelope data signal ENV outputted from the envelope detecting circuit 22 is inputted to a differentiation circuit 23 which is designed to determine arithmetically differentials of the envelope data signal inputted continuously to thereby output a signal which varies in response to rise-up and fall of the envelope sinal. As a typical one of the differentiation circuit suited to this end, there may be mentioned such a differentiation circuit which is designed to derive the differential by performing convolution (Faltung) integration on the envelope data with the aid of a window function W(τ), as is illustrated in FIG. 5A. Expressing the concept of this differentiation in the mathematic form, $$y(t) = \frac{1}{2\tau_0} \sum_{\tau=-\tau_0}^{\tau_0} W(\tau)\, x(t+\tau) \tag{1}$$

where x(t): input speech signal, y(t): output of the differentiation circuit, and W(t): window function.

On the other hand, the delay circuit 21 operates to delay the input speech signal for a time taken for the detection of the envelope and determination of the differentials mentioned above. The output of the delay circuit 21 is supplied to a temporal gap extending unit 24. More specifically, the output D-OUT of the delay circuit 21 and the output DIFF of the differentiation circuit 23 are inputted to the temporal gap extension unit 24 which is designed for detection of the temporal gap and extension thereof.

Figure 6:
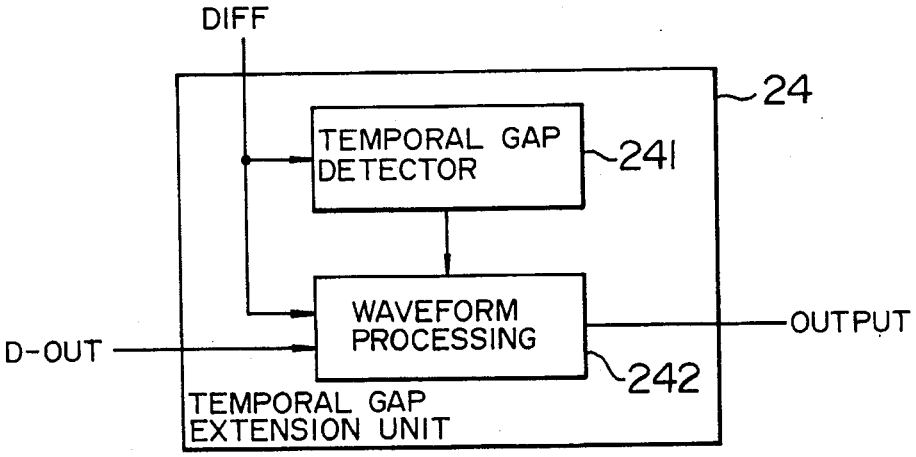
FIG. 6 is a circuit diagram showing in detail a structure of a temporal gap extension unit in the apparatus shown in FIG. 4.

FIG. 6 is a circuit diagram showing a structure of the temporal gap extension unit 24. As can be seen in the figure, the temporal gap extension unit 24 includes a temporal gap detection circuit 241 which is designed to detect as the temporal gap a period during which the output DIFF of the differentiation circuit 23 changes from a peak value of negative polarity to a peak value of positive polarity. (More specifically, the period during which the output signal DIFF changes from the negative peak value to the positive peak value is determined, and when the above period is longer than a preset shortest temporal gap, that period is detected as the temporal gap.) A waveform processing circuitry 242 extends the temporal gap contained in the speech signal which is supplied as the output D-OUT of the delay circuit 21 on the basis of the results of the detection processing mentioned above. The waveform processing may be performed in the same manner as described hereinbefore in conjunction with the first embodiment.

Figure 7:
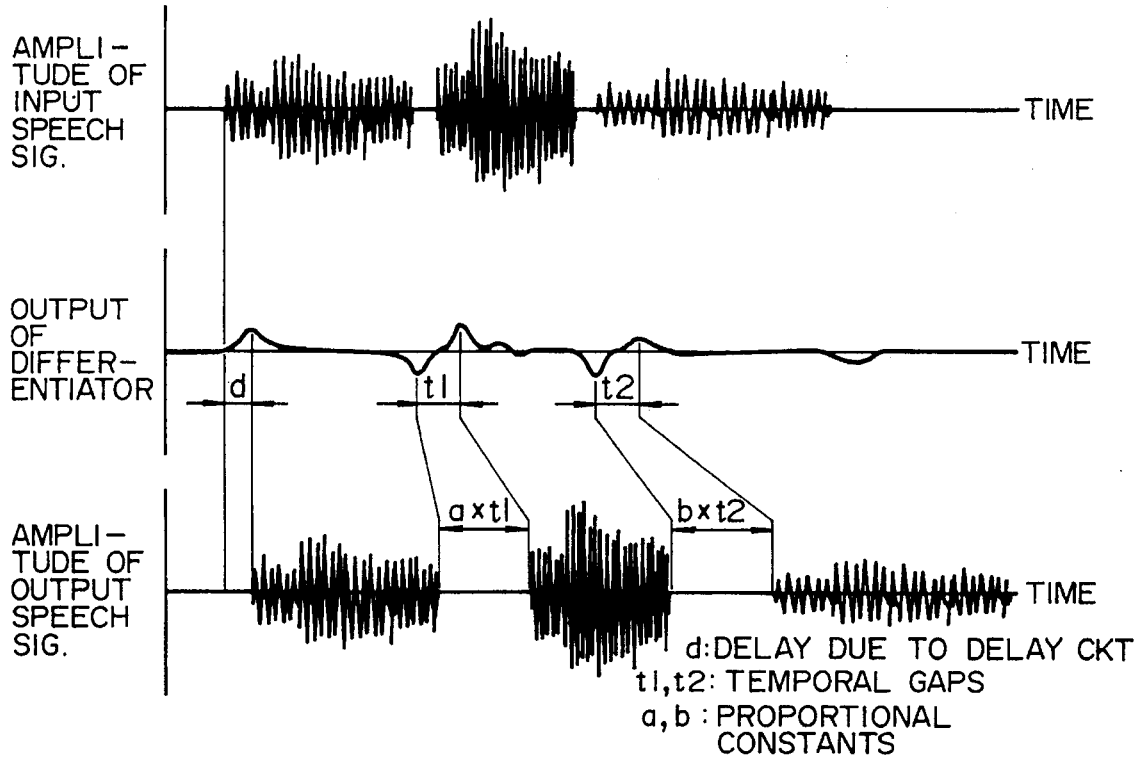
FIG. 7 is a speech waveform diagram for illustrating how the temporal gap extension processing is performed by using the differential values.

FIG. 7 shows, by way of example, speech waveforms for illustrating how the temporal gap extension processing is performed. Referring to the figure, there makes appearance in the output signal of the differentiation circuit 23 a peak value of positive polarity at a point of transition from a temporal gap to a voice duration in the input speech signal, while a peak of negative polarity makes appearance at a point of transition from a voice duration a temporal gap. The inter-peak time span intervening the negative peak and the succeeding positive peak is decided as the temporal gap, and the degree or rate of extension of the temporal gap, i.e., the number of repetition effected upon outputting of the temporal gap is so determined as to be proportional to the absolute value of the negative peak occurred immediately before the temporal gap of concern. In the case of the example illustrated in FIG. 7, the two temporal gaps t1 and t2 are detected and outputted after having been extended by factors a and b, respectively.

Figure 5B:
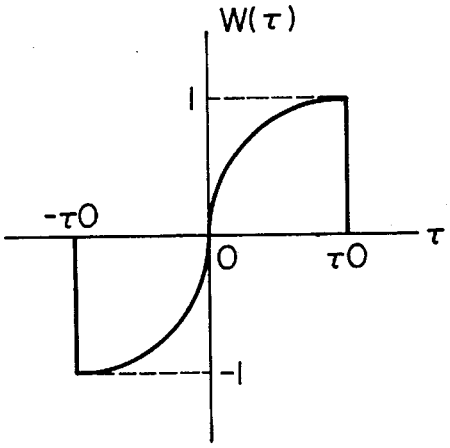
FIG. 5B is a view similar to FIG. 5A except that a window function of non-linear form is employed.

In the above description of the second embodiment of the invention, it has been assumed that the window function W(τ) is of a linear form having a slope of a positive value. It is however apparent that such a window function which exhibits a reverse slope may equally be employed to the utterly same effect. In that case, a period during which the output of the differentiation circuit 23 changes from a positive peak to a negative peak is detected as the temporal gap. Furthermore, it is apparent that the window function W(τ) of the linear form shown in FIG. 5A may be replaced by a window function of non-linear form such as illustrated in FIG. 5B together with a weighted summation, to the substantially same effect.

According to the teachings of the invention incarnated in the second embodiment described above, the temporal gap is detected on the basis of changes in the envelope signal. Owing to this feature, detection of the temporal gap can positively be protected against the adverse influence of any steady noise component superposed on the speech signal even though amplitude of the envelope signal increases correspondingly. In the foregoing description, it has been assumed that the input speech signal undergoes the temporal gap detection/extension processing after having been converted to the digital signal. It goes however without saying that the input analogue speech signal may intactly be inputted to an analogue envelope detection circuit for detecting an envelope signal, while the input speech signal is delayed with an analogue delay means, wherein the envelope data signal is differentiated by resorting to an analogue processing to detect the temporal gap while processing the speech waveforms for thereby extending the temporal gap. In this case, the mathematical expression (1) for deriving the differentials by performing the convolution (Faltung) integration on the envelope data with the window function may simply be so rewritten for the analogue processing that the summation symbol "Σ" is replaced by the integration symbol "∫".

Figure 8:
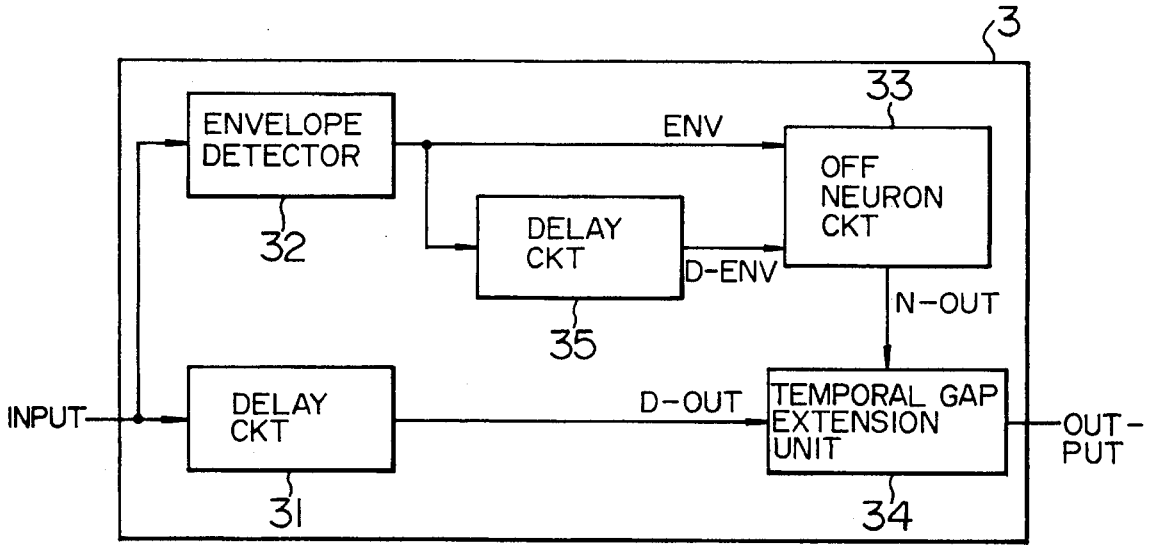
FIG. 8 is a block diagram showing a configuration of a temporal gap detection/extension apparatus according to a third embodiment of the present invention.

FIG. 8 shows in a block diagram a structure of the temporal gap detection/extension apparatus according to a third embodiment of the invention in which an OFF neuron circuit is employed.

Referring to FIG. 8, an input speech signal is converted to a digital signal by an A/D converter (not shown). The digital speech signal resulting from the A/D conversion is inputted to an envelope detection circuit 32 and at the same time to a memory (not shown) incorporated in a second delay circuit 31, as in the case of the second embodiment. The envelope data detected by the envelope detection circuit 32 is inputted to a memory (not shown) provided in a first delay circuit 35. An OFF neuron circuit 33 which is constituted by a digital circuit receives the envelope data ENV detected by the envelope detection circuit 32 and the envelope data D-ENV delayed through the delay circuit 35 and outputs signals N-OUT which corresponds to the rise-up and the falling of the envelope signal. On the other hand, the second delay circuit 31 serves for delaying the input speech signal for a time taken for the OFF neuron circuit 33 to produce the output signal N-OUT. The delayed input speech signal D-OUT is inputted to the temporal gap extension unit 34, which utilizes the output N-OUT of the OFF neuron circuit 33 to perform detection and extension of the temporal gap contained in the delayed input speech signal D-OUT.

Figure 9:
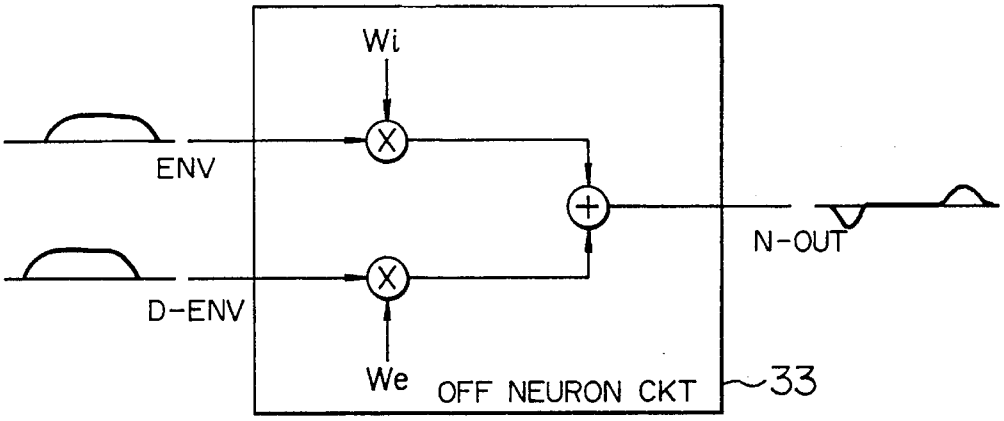
FIG. 9 is a circuit diagram showing a structure of an OFF neuron circuit employed in the apparatus shown in FIG. 8.

The OFF neuron circuit 33 mentioned above serves to detect the rise-up and the falling, i.e., the transition period from the voice interval or duration to the quiescent or temporal gap in the speech signal, on the basis of the envelope data ENV and the delayed envelope data D-ENV. The nerve cell referred to as the OFF neuron which can widely be found in the sense organs such as visual and auditory sense organs of a living body is a nervous tissue which reacts singularly only when an input signal as being applied is removed, i.e., rendered "OFF" and which plays an important roll in the information processing performed by the visual/auditory sense organs. The OFF neuron circuit is designed to simulate partially the OFF neuron (nerve cell) for detecting the point of change in the input signal. More specifically, the OFF neuron circuit can be implemented such that predetermined weight is applied to the envelope signal ENV and the delayed envelope signal D-ENV inputted incessantly, wherein the result of addition of the weighted envelope signals is produced as the output signal, as can be seen in FIG. 9. In this conjunction, a negative value is selected for the weight Wi applied to the envelope data ENV, while a positive value is selected as the weight We which is to be applied to the delayed envelope data D-ENV, wherein absolute values of these two weights are equal to each other. On these conditions, the OFF neuron circuit 33 outputs a negative value during a period in which the envelope signal rises up while outputting a positive value when the envelope signal is falling. Further, magnitude of the output of the OFF neuron circuit 33 assumes a value which corresponds to the amplitude of the envelope of the input speech signal. Furthermore, since the two input signals supplied to the OFF neuron circuit 33 are identical with each other except that one is delayed relative to the other, influence of any steady noise possibly contained in the input speech can be canceled out through the weighted addition mentioned above. On the other hand, the temporal gap extension unit 34 detects as the temporal gap a time span intervening between the output of the positive value of the OFF neuron circuit 33 and the succeeding output of the negative value therefrom (more specifically, the period intervening between the output of the positive value from the OFF neuron circuit 33 and the succeeding output of the negative value is determined, and when this period is longer than a preset shortest temporal gap, the former is detected as the temporal gap.), whereby the corresponding temporal gap or gaps contained in the input signal delayed by the delay circuit 31 are outputted repeatedly to thereby realize extension of the temporal gap. At this juncture, it should be mentioned that by setting the number of the repetition mentioned above so that it is in proportion to the amplitude output of the OFF neuron circuit 33 used for detection of the temporal gap, extension of the temporal gap which bears dependency on magnitude of the input speech can be realized.

Figure 10:
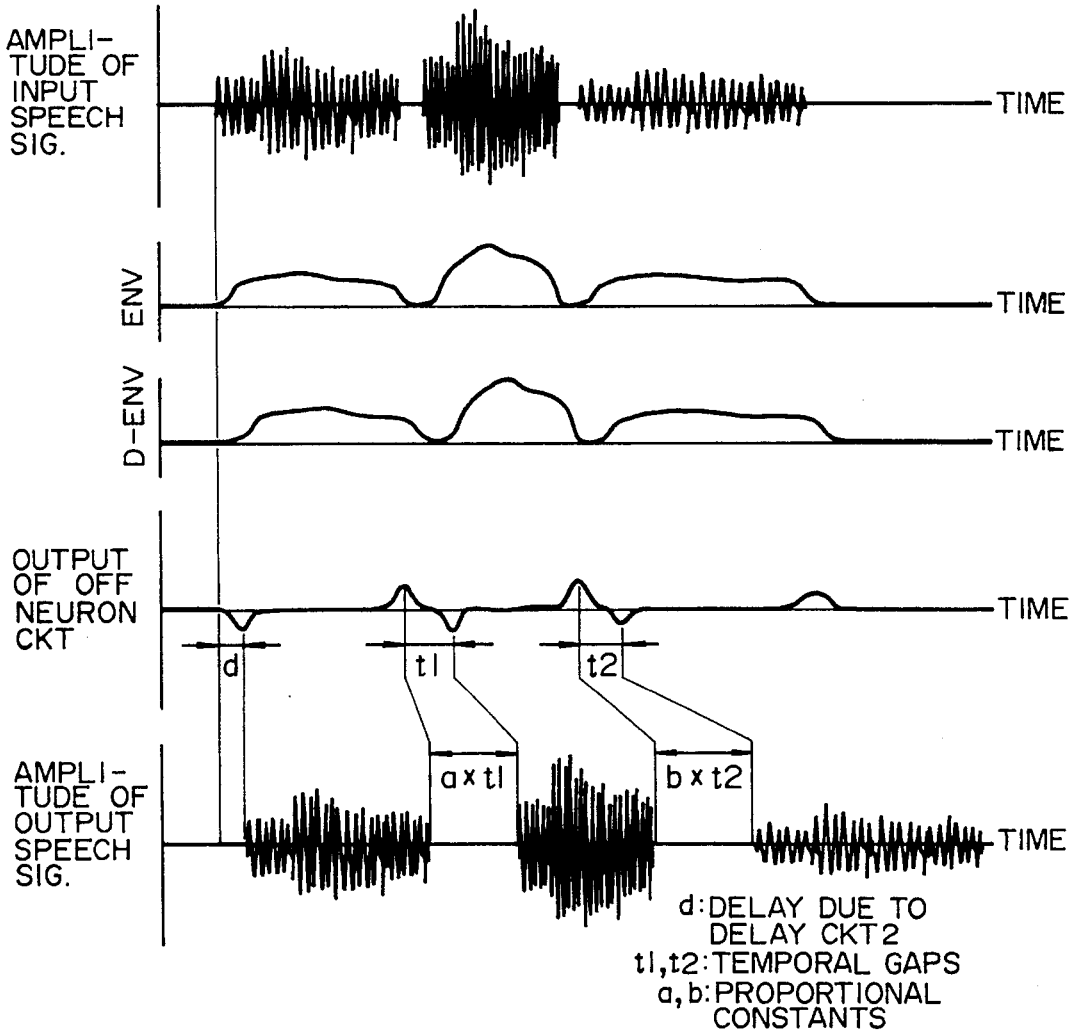
FIG. 10 is a waveform diagram for illustrating a temporal gap extension processing performed by the apparatus shown in FIG. 8.

FIG. 10 shows, by way of example, speech waveforms for illustrating the temporal gap extension processing described above. The result of the weighted addition of the envelope signal of the input speech and the delayed envelope signal represents the output of the OFF neuron circuit 33. In the case of the example now under consideration, it is assumed that the weight We is a positive value with the weight Wi being a negative value. Thus, there makes appearance in the output of the OFF neuron circuit 33 a negative peak at a point of transition from a temporal gap to a voice interval or duration with a positive peak appearing upon transition from a voice interval to a temporal gap. The time span or period between the positive peak and the succeeding negative peak is decided as the temporal gap, wherein degree or rate of extension of the temporal gap, i.e., the number of repetition at which the temporal gap is outputted, is so determined as to be proportional to the absolute value of the positive peak occurred immediately before the temporal gap. In the case of the speech signal shown in FIG. 10, there exist two temporal gaps t1 and t2 which are outputted after having been extended by factors of a and b, respectively.

In a modification of the embodiment described above, the signs imparted to the weights We and Wi of the OFF neuron circuit 33 may be reversed with the polarities of the output of the OFF neuron circuit 33 being correspondingly reversed so that the period taken for the OFF neuron output of a negative value to assume a positive value is detected as the temporal gap, to the utterly same effect. Further, although it has been assumed in the foregoing description of the third embodiment that the input speech signal is digitized for the temporal gap detection and extension processing. However, it goes without saying that the input speech signal can be applied to the envelope detection circuit intactly as the analogue signal for detecting the envelope thereof through analogue processing, and the envelope signal as well as the input speech signal is delayed with the aid of an analogue delay circuit, while the OFF neuron circuit is constituted by an analogue circuit, wherein detection and extension of the temporal gap are performed by utilizing the output of the OFF neuron circuit in the manner described above.

According to the teachings of the invention incarnated in the embodiment described above, extension of the temporal gap as detected is effected by outputting repeatedly the detected temporal gap. In this conjunction, it is noted that parts of the preceding and succeeding voice interval are often contained at the ends of the data stream outputted repeatedly. In that case, voice components of short duration are also repeatedly outputted, presenting a new noise source. To evade this problem, such a method may be adopted that instead of repeating the detected temporal gap as a whole, only a center or intermediate portion of the temporal gap is repeated with both end portions being cut off. It is further noted that when the input speech signal contains noise superposed on the voice information, the temporal gap detected through the envelope threshold processing is prone to contain noise. In that case, when the extension of the temporal gap is performed as described previously, the noise is also outputted repeatedly, giving rise to periodical generation of audible noise components. This difficulty can be avoided by adopting a method of repeating the temporal gap by lowering the signal level.

In the foregoing description, a single speech signal is of concern. However, a man has inherently two ears for sensing the sound. Accordingly, in the apparatus such as the hearing aids, it is desirable to perform two-channel processing for both ears. In that case, detection of the temporal gap may be performed in either one of the channels while the extension processing may be carried out in both channels. Channel selection for detection of the temporal gap may be made such that the temporal gap detection channel is assigned to the channel for the ear more sensitive or alternatively the channel in which the envelope signal has a greater magnitude may be assigned as the temporal gap detection channel. Besides, such a method is also conceivable in which a mean value of the outputs of both channels is arithmetically determined and the temporal gap is detected on the basis of the envelope of the mean value signal.

The temporal gap detection/extension apparatus according to the present invention can be applied to communication equipment such as telephone and the like as well. In other words, the speech temporal gap detection and extension processing for the speech signal inputted to the hearing aids or the like may be added to a speech generation apparatus for a communication system such as the telephone for the purpose of extending the temporal gaps in the speech emitted from the receiver, to thereby aid the weakened auditory sense organ. In the case where the present invention is applied to the receiver through a telephone line, there arises a problem of temporal offset between the receiver and the transmitter. However, this problem can be solved satisfactorily for practical applications by informing previously the sender or speaker of occurrence of a time lag for allowing him or her to place pauses appropriately in the conversation.

Figure 11:
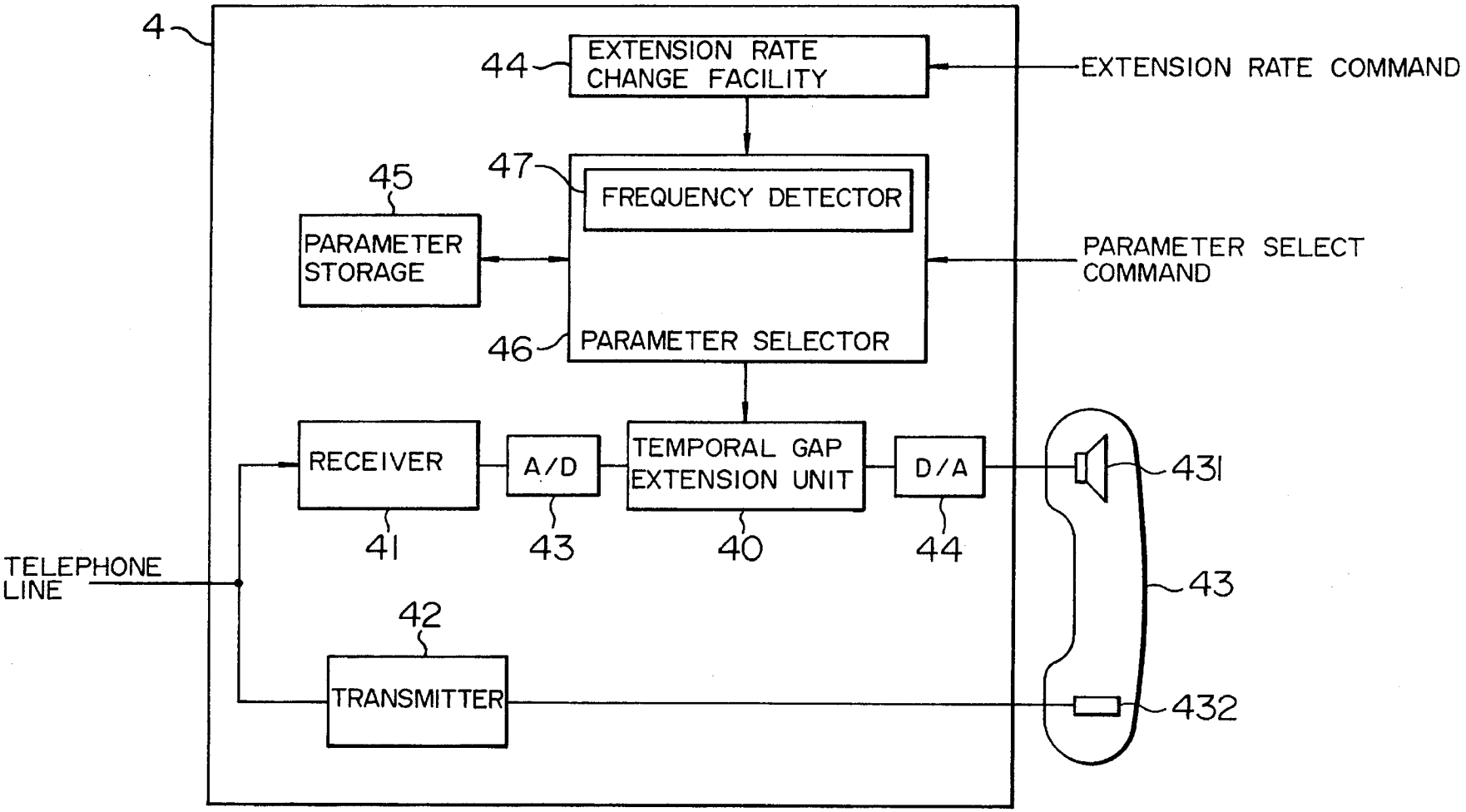
FIG. 11 is a block diagram showing a circuit configuration of a telephone to which a temporal gap detection/extension apparatus according to the invention is applied.

FIG. 11 is a block diagram showing a circuit configuration of a telephone apparatus to which the temporal gap detection/extension apparatus according to the first, second or third embodiment of the invention is applied. Referring to the figure, a telephone denoted generally by a numeral 4 includes a receiver circuit 41 for extracting a speech signal sent to the telephone via a telephone line and a transmitter circuit 42 which sends out a speech signal generated by a microphone 432 accommodated within a handset 43 after having converted the speech signal to a signal for transmission via the telephone line. The temporal gap extension circuit 40 may be constituted by one of those described hereinbefore in conjunction with the first, second and third embodiments of the invention (refer to FIGS. 1, 4 and 8). When the telephone line is of analogue type, the speech signal is not digitized. Accordingly, the analogue signal extracted through the receiver circuit 41 is once converted to a digital signal through an A/D converter 43, and the digital signal resulting therefrom is then subjected to the temporal gap extension processing described hereinbefore and subsequently converted again to the analogue signal through a D/A converter 44, which analogue signal is then outputted from a speaker 431 housed within the handset 43. On the other hand, when the telephone line is of digital network, the signal sent to the telephone is digitally encoded. Accordingly, decoding processing is performed by the receiver circuit 41 as in the case of the conventional digital telephone to thereby derive a digital speech signal which then undergoes the temporal gap extension processing through the temporal gap extension circuit 40 without passing through the A/D converter 43. The output signal from the temporal gap extension circuit 40 is then converted to an analogue signal through the D/A converter 44 to be outputted through the speaker 431.

The telephone according to the instant embodiment includes an extension rate change circuit 44 for changing the rate of the temporal gap extension in dependence on the user. With the aid of this extension rate change circuit 44, the user can perform conversation by adjusting the extension rate, for example, with a manipulating knob provided to this end for setting set a volume most easy to follow the speech. Further, the telephone according to the instant embodiment includes a parameter storage unit 45 for storing signal processing parameters representing extension rates. Upon completion of the telephone conversation, the parameter representing the extension rate used in the conversation may be stored in this parameter storage unit 45. When the user desires to perform telephone conversation next time on the same condition as that used in the past, he or she may select one of the parameters stored in the parameter storage unit 45 through the medium of a parameter selector 46, the selected parameter being transferred to the temporal gap extension circuit 40.

In the telephone apparatus according to the instant embodiment, the parameter selector 46 may include a frequency detector 47 which has a function to detect the parameter which is used at a highest frequency from a plurality of parameters stored in the parameter storage unit 45. The parameter of the highest frequency is used as the initial parameter which is set upon starting the conversation through the telephone. Of course, when the user desires to use other parameter, it can be selected by manipulating the extension rate change means 44.

As a modification, such a simplified arrangement may also be adopted that a default value is previously set in the temporal gap extension circuit 40, wherein the selection or non-selection of the temporal gap extension is commanded through manipulation of a switch provided externally to this end. In that case, the extension rate change circuit 44, the parameter storage unit 45 and the parameter selector 46 can be spared.

The foregoing description has been directed to the telephone in which the temporal gap extension circuit is employed in association with the receiver. However, the temporal gap detection/extension circuit according to the present invention may be inserted immediately after the microphone of the transmitter so that the speech processing is performed at the side of the transmitter. With this arrangement, the weakened auditory sense organ can be aided without imposing no burden on the receiver. This arrangement is advantageous over the case where the invention is applied to the receiver in that S/N ratio of the speech signal to be processed is improved, whereby the temporal gap detection and extension can be performed with a higher accuracy. The present invention may further be applied to a so-called caretaker telephone for aiding a hearing-impaired person to follow the speech reproduced from a recorder incorporated in this kind of telephone.

Figure 12:
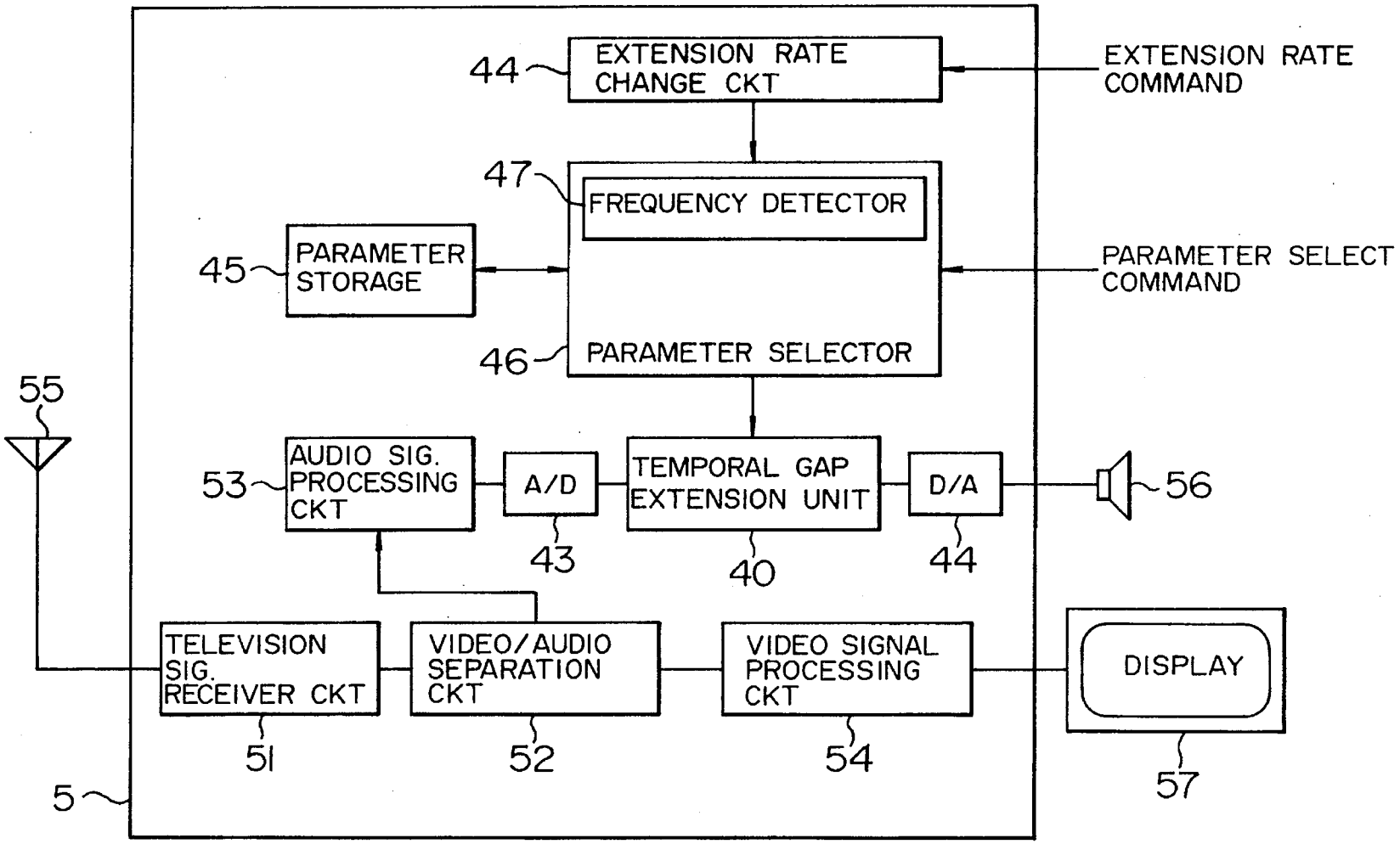
FIG. 12 is a block diagram showing a configuration of a television receiver in which a temporal gap detection/extension apparatus according to the invention is applied.

The temporal gap extension apparatus according to the present invention can further find application to electrical appliances having audio outputs such as those exemplified by a radio receiver, a television receiver and the like. FIG. 12 shows another embodiment of the invention in which the temporal gap detection/extension apparatus described previously in conjunction with the first to the third embodiments is used in a television receiver. A television signal carried by a broadcast electromagnetic wave is extracted through a television signal receiver circuit 51 and supplied to a video/audio signal separator circuit 52 to be separated into a video signal and an audio signal. The video signal is processed by a video signal processing circuit 54 to be displayed on a CRT 57.

On the other hand, the separated audio signal is converted to an analogue signal of a voice-frequency band by an audio signal processing circuit 53. The analogue signal is then digitized by an A/D converter 43, the resulting digital signal being transferred to the temporal gap extension circuit 40 which is constituted at least by one of the temporal gap detection/extension apparatuses described hereinbefore in conjunction with the first, second and third embodiments (refer to FIG. 1, 4 or 8) of the invention, to undergo the temporal gap detection and extension processing described hereinbefore. The digital audio signal having the temporal gaps extended is converted to an analogue signal by a D/A converter 44 to be outputted from a speaker 56.

The television receiver according to the instant embodiment includes the parameter storage unit 45, the parameter selector 46 and the extension rate change circuit 44, the functions of which are same as those of the telephone apparatus described previously by reference to FIG. 11. Of course, these components 44, 45 and 46 may be spared by setting previously a default value in the temporal gap extension circuit 40 so that selection or non-selection of enhancement can externally be commanded through a switch manipulation.

Figure 13:
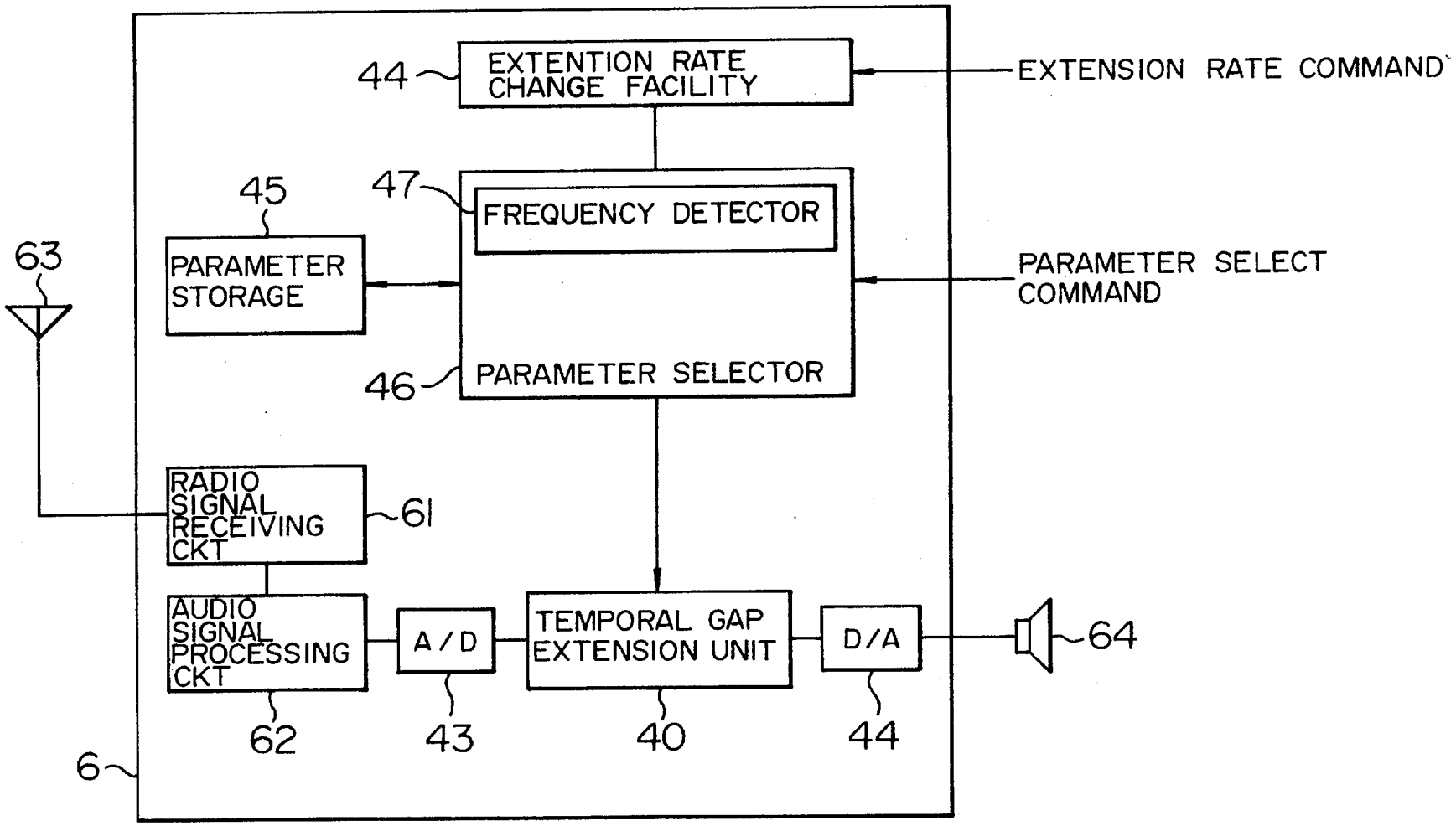
FIG. 13 is a block diagram showing a configuration of a radio receiver in which a temporal gap detection/extension apparatus according to the invention is applied.

FIG. 13 shows a further embodiment of the present invention in which the temporal gap detection/extension apparatus described previously in conjunction with the first to the third embodiments is used in a radio receiver. A radio signal carried by a broadcast radio wave is extracted through a radio wave receiver circuit 61 and supplied to an audio signal processing circuit 62 to be converted to an analogue signal of a voice-frequency band. The analogue signal is then digitized by an A/D converter 43, the resulting digital signal being transferred to the temporal gap extension circuit 40 which is constituted at least by one of the temporal gap detection/extension apparatuses described hereinbefore in conjunction with the first, second and third embodiments (refer to FIG. 1, 4 or 8), to undergo the temporal gap detection and extension processing described hereinbefore. The digital audio signal having the temporal gaps extended is converted to an analogue signal by a D/A converter 44 to be outputted from a speaker 64.

The radio receiver according to the instant embodiment includes the parameter storage unit 45, the parameter selector 46 and the extension rate change circuit 44, the functions of which are same as those of the telephone apparatus described previously by reference to FIG. 11. Of course, these components 44, 45 and 46 may be spared by setting previously a default value in the temporal gap extension circuit 40 so that selection or non-selection of enhancement can externally be commanded through a switch manipulation. In this case, the structure of the radio receiver can be much simplified.

The present invention is not limited to the applications to the telephone, television receiver and the radio receiver shown in FIGS. 11 to 13 but can find more extensive applications to various speech utilizing appliances such as audio-recorders typified by a tape recorder, VTR (video tape recorder), CD (compact disk), DCC (digital compact cassette), MD (mini-disk) and the like devices , speech output appliances connected to WS (work station), PC (personal computer) and the like, WP (word processor) having an in-voice reading out function, electronic mail and the like apparatus as well as other instruments, machines and systems in other industrial fields. Further, in the education for juveniles with hearing loss, the invention may be applied to an apparatus for processing speech signal outputted from a microphone to aid a plurality of hearing-impaired listeners in hearing. Besides, the temporal gap detection scheme taught by the invention can also be utilized in segmentation of a speech signal in an automatic speech recognition system, needless to say.

It should further be mentioned that although the temporal gap detection and extension apparatus can easily be realized by using a general-purpose DSP (digital signal processor), it may equally be implemented by dedicated hardware or software designed to run on a general-purpose microcomputer.

As will be appreciated from the foregoing description, according to the invention, the quiescent or no-voice intervals, i.e., the temporal gaps can be detected without being influenced by noise even when the level of speech signal varies due to noise components, while the rate of extension of the temporal gap can be controlled in dependence on the power of the speech signal. In other words, the temporal gap can be detected and extended dynamically on a real-time basis in accordance with the input speech signal. By applying the apparatus and the method according to the invention to appliances such as hearing aids or the like for backing up the weakened auditory organ and other electrical appliances having speech signal outputs, deterioration in the temporal resolution ability of the hearing-impaired person, e.g., low clearness of voice due to temporal masking phenomenon to which consideration has not duly been paid heretofore can be compensated for so that the people with hearing loss can understand or follow the speech more clearly and comfortably.

We claim:

1. An apparatus for detecting and extending temporal gaps in a speech signal for the purpose of aiding an auditory sense organ, comprising:

temporal gap detection means for detecting temporal gaps in an input speech signal; and temporal gap extension means for extending each temporal gap in said input speech signal detected by said temporal gap detection means in proportion to power of said input speech signal at a point in time immediately preceding a point in time at which said temporal gap occurred.

2. An apparatus according to claim 1, further comprising:

envelope detection means for detecting an envelope from the input speech signal converted to a digital signal;

means for detecting a maximum value and a minimum value of said envelope; and a memory for storing at least speech information of said input speech, data of said envelope said maximum value and said minimum value;

wherein said temporal gap detecting means detects as the temporal gap an interval in which said envelope is smaller than a threshold value set at a given value between said maximum value and said minimum value.

3. An apparatus for detecting and extending temporal gaps in a speech signal for the purpose of aiding an auditory sense organ, comprising:

temporal gap detection means for detecting temporal gaps in an input speech signal;

temporal gap extension means for extending a signal of the temporal gap detected by said temporal gap detection means in proportion to power of said input speech signal at a point in time immediately preceding a point in time at which said temporal gap occurred;

envelope detection means for detecting an envelope from the input speech signal converted to a digital signal;

means for detecting a maximum value and a minimum value of said envelope; and a memory for storing at least speech information of said input speech, data of said envelope said maximum value and said minimum value;

wherein said temporal gap detecting means detects as the temporal gap an interval in which said envelope is smaller than a threshold value set at a given value between said maximum value and said minimum value;

wherein said envelope detecting means detects the envelope of said input speech signal by performing temporally averaging operation on said input speech signal, and wherein said temporal gap detecting means determines an interval in which the detected envelope continues to be of a smaller value than said threshold value and detects said interval as the temporal gap when said interval is longer than a preset shortest duration of the temporal gap.

4. An apparatus for detecting and extending temporal gaps in a speech signal for the purpose of aiding an auditory sense organ, comprising:

temporal gap detection means for detecting temporal gaps in an input speech signal; and temporal gap extension means for extending a signal of the temporal gap detected by said temporal gap detection means in proportion to power of said input speech signal at a point in time immediately preceding a point in time at which said temporal gap occurred;

wherein said temporal gap extension means extends said temporal gap to a value of an envelope of a voice duration at a said point in time immediately preceding said point in time at which the temporal gap occurred or to a value proportional to a maximum value of said envelope.

5. An apparatus according to claim 4, wherein said temporal gap extension means adds repeatedly to said temporal gap an intermediate part thereof exclusive of both end portions corresponding to the start and the end, respectively, of said temporal gap.

6. An apparatus according to claim 4, wherein said temporal gap extension means adds said temporal gap with a temporal gap whose signal level is lowered relative to that of the temporal gap in said input speech signal.

7. An apparatus for detecting and extending temporal gaps in a speech signal for the purpose of aiding an auditory sense organ, comprising:

temporal gap detection means for detecting temporal gaps in an input speech signal;

temporal gap extension means for extending a signal of the temporal gap detected by said temporal gap detection means in proportion to power of said input speech signal at a point in time immediately preceding a point in time at which said temporal gap occurred;

means for detecting an envelope from the input speech signal converted to a digital signal;

a differentiation circuit for computing differential values of said envelope; and a delay circuit for delaying said input speech signal for a time taken by said differentiation circuit to carry out said computation;

wherein said temporal gap detection means detects as said temporal gap an interval in which the differential values vary from a negative peak value to a positive peak value.

8. An apparatus according to claim 7, wherein said envelope detecting means detects the envelope of said input speech signal by performing temporally averaging operation on said input speech signal, and wherein said temporal gap detecting means determines an interval in which the differential values of the envelope determined by said differentiation circuit vary from a negative peak value to a positive peak value and detects said interval as the temporal gap when said interval is longer than a shortest duration preset for the temporal gap.

9. An apparatus according to claim 7, wherein said differentiation circuit determines said differential values by performing a convolution (Faltung) integration operation on said input speech signal converted to a digital signal with a window function having a form point-symmetrical to the origin.

10. An apparatus according to claim 9, wherein said differentiation circuit uses a window function having a positive or negative slope.

11. An apparatus according to claim 9, wherein said differentiation circuit performs weighted summation by using a non-linear window function.

12. An apparatus according to claim 7, wherein said temporal gap extension means extends said temporal gap in proportion to power of the negative peak value taken by the differential value immediately before said temporal gap.

13. An apparatus according to claim 12, wherein said temporal gap extension means adds repeatedly to said temporal gap an intermediate part thereof exclusive of both end portions corresponding to the start and the end, respectively, of said temporal gap.

14. An apparatus according to claim 12, wherein said temporal gap extension means adds said temporal gap with a temporal gap whose signal level is lowered relative to that of the temporal gap in said input speech signal.

15. An apparatus for detecting and extending temporal gaps in a speech signal for the purpose of aiding an auditory sense organ, comprising:

temporal gap detection means for detecting temporal gaps in an input speech signal;

temporal gap extension means for extending a signal of the temporal gap detected by said temporal gap detection means in proportion to power of said input speech signal at a point in time immediately preceding a point in time at which said temporal gap occurred;

means for detecting an envelope from the input speech signal converted to a digital signal;

a first delay circuit for delaying data of said envelope;

an OFF neuron circuit for receiving the envelope data and a delayed envelope data corresponding thereto, applying predetermined weights to said envelope data and said delayed envelope data, respectively, and simulating operation of an OFF neuron by adding together said envelope data and said delayed envelope data, to thereby output signals corresponding to rising-up and falling of said envelope, respectively; and a second delay circuit for delaying said input speech signal for a time taken for said OFF neuron circuit to perform said operation;

wherein said temporal gap detection means detects as the temporal gap an interval intervening between output of a positive value from said OFF neuron circuit and succeeding output of a negative value from said OFF neuron circuit.

16. An apparatus according to claim 15, wherein said envelope detecting means detects the envelope of said input speech signal by performing temporally averaging operation on said input speech signal, and wherein said temporal gap detecting means determines an interval which intervenes between output of a positive value from said OFF neuron circuit and succeeding output of a negative value from said OFF neuron circuit and detects said interval as the temporal gap when said interval is longer than a shortest duration preset for the temporal gap.

17. An apparatus according to claim 15, wherein negative/positive polarity relation in said OFF neuron circuit is reversed such that an interval intervening between output of a negative value from said OFF neuron circuit and succeeding output of a positive value therefrom is detected as the temporal gap.

18. An apparatus according to claim 15, wherein said temporal gap extension means extends said temporal gap in proportion to output power of said OFF neuron circuit at a time point immediately preceding to said temporal gap.

19. An apparatus according to claim 18, wherein said temporal gap extension means adds repeatedly to said temporal gap an intermediate part thereof exclusive of both end portions corresponding to the start and the end, respectively, of said temporal gap.

20. An apparatus according to claim 18, wherein said temporal gap extension means adds said temporal gap with a temporal gap whose signal level is lowered relative to that of the temporal gap in said input speech signal.

21. An apparatus for detecting and extending temporal gaps in a speech signal for the purpose of aiding an auditory sense organ, comprising:

temporal gap detection means for detecting temporal gaps in an input speech signal; and temporal gap extension means for extending a signal of the temporal gap detected by said temporal gap detection means in proportion to power of said input speech signal at a point in time immediately preceding a point in time at which said temporal gap occurred;

wherein said temporal gap detecting means performs detection of the temporal gap by utilizing the input speech signal in either one of input channels to ears of a listener of said input speech signal, and wherein said temporal gap extension means extends the temporal gap in both the input speech signals in said two channels.

22. An apparatus according to claim 21, wherein said one channel utilized by said temporal gap detection means is one of said two channels whose input speech signal has a greater power than that of the input speech signal in the other channel.

23. An apparatus according to claim 21, wherein said one channel utilized by said temporal gap detection means is a channel oriented for the more sensitive ear of a listener of said input speech.

24. An apparatus for detecting and extending temporal gaps in a speech signal for the purpose of aiding an auditory sense organ, comprising:

temporal gap detection means for detecting temporal gaps in an input speech signal; and temporal gap extension means for extending a signal of the temporal gap detected by said temporal gap detection means in proportion to power of said input speech signal at a point in time immediately preceding a point in time at which said temporal gap occurred;

wherein said temporal gap detection means performs detection of the temporal gap by using a mean value signal of the input speech signals of two channels inputted to ears of a listener of said input speech, and wherein said temporal gap extension means extends the temporal gaps in both input speech signals of said two channels, respectively.

25. A method of detecting and extending temporal gaps in a speech signal for the purpose of aiding an auditory sense organ, comprising the steps of:

detecting temporal gaps in an input speech signal; and extending each temporal gap in said input speech signal detected in said temporal gap detection step in proportion to power of said input speech signal at a point in time immediately preceding a point in time at which said temporal gap occurred.

26. A temporal gap detection/extension method according to claim 25, further comprising the steps of:

detecting an envelope from the input speech signal converted to a digital signal;

detecting a maximum value and a minimum value of said envelope;

storing at least speech information of said input speech, data of said envelope, said maximum value and said minimum value;

detecting as the temporal gap an interval in which said envelope is smaller than a threshold value set at a given value between said maximum value and said minimum value; and extending said temporal gap in proportion to power of said input speech at said point in time immediately preceding said point in time at which said temporal gap occurred.

27. A method of detecting and extending temporal gaps in a speech signal for the purpose of aiding an auditory sense organ, comprising the steps of:

detecting temporal gaps in an input speech signal;

extending a signal of the temporal gap detected in said temporal gap detection step in proportion to power of said input speech signal at a point in time immediately preceding a point in time at which said temporal gap occurred;

detecting an envelope from the input speech signal converted to a digital signal;

computing differential values of said envelope;

delaying said input speech signal for a time taken by said computation;

detecting as said temporal gap an interval in which the differential values vary from a negative peak value to a positive peak value; and extending said temporal gap in proportion to power of the negative peak value taken by said differential value at a time point immediately preceding to said temporal gap.

28. A method of detecting and extending temporal gaps in a speech signal for the purpose of aiding an auditory sense organ, comprising the steps of:

detecting temporal gaps in an input speech signal;

extending a signal of the temporal gap detected in said temporal gap detection step in proportion to power of said input speech signal at a point in time immediately preceding a point in time at which said temporal gap occurred;

detecting an envelope from the input speech signal converted to a digital signal;

delaying data of said envelope;

fetching the envelope data and a delayed envelope data corresponding thereto, applying predetermined weights to said envelope data and said delayed envelope data, respectively, and simulating operation of an OFF neuron for adding together said envelope data and said delayed envelope data, to thereby output signals corresponding to rising-up and falling of said envelope, respectively;

delaying said input speech signal for a time taken for said OFF neuron operation;

detecting as the temporal gap an interval intervening between output of a positive value from said OFF neuron operation and succeeding output of a negative value from said OFF neuron operation; and extending said temporal gap in proportion to power of output derived from said OFF neuron operation at a time point immediately preceding to said temporal gap.

29. A telephone apparatus equipped with an apparatus for detecting and extending temporal gaps in a speech signal for the purpose of aiding an auditory sense organ, comprising:

temporal gap extension means for detecting a temporal gap in an input speech signal and extending the temporal gap as detected in proportion to power of said input speech signal at a point in time immediately preceding a point in time at which said temporal gap occurred; and means for changing rates of extension of said temporal gap.

30. A telephone apparatus according to claim 29, further comprising:

parameter storage means for storing parameter sets representing said extension rates; and parameter selector means for selecting a parameter set used in the past from said parameter storage means.

31. A telephone apparatus according to claim 30, wherein said parameter selector means includes frequency detection means for detecting the parameter set used at a highest frequency from a plurality of the parameter sets.

32. A television receiver equipped with an apparatus for detecting and extending temporal gaps in a speech signal for the purpose of aiding an auditory sense organ, comprising:

temporal gap extension means for detecting a temporal gap in an input speech signal and extending the temporal gap as detected in proportion to power of said input speech signal at a point in time immediately preceding a point in time at which said temporal gap occurred; and means for changing rates of extension of said temporal gap.

33. A television receiver according to claim 32, further comprising:

parameter storage means for storing parameter sets representing said extension rates; and parameter selector means for selecting a parameter set used in the past from said parameter storage means.

34. A television receiver according to claim 33, wherein said parameter selector means includes frequency detection means for detecting a parameter set used at a highest frequency from a plurality of the parameters.

35. A radio receiver equipped with an apparatus for detecting and extending temporal gaps in a speech signal for the purpose of aiding an auditory organ, comprising:

temporal gap extension means for detecting a temporal gap in an input speech signal and extending the temporal gap as detected in proportion to power of said input speech signal at a point in time immediately preceding a point in time at which said temporal gap occurred; and means for changing rates of extension of said temporal gap.

36. A radio receiver according to claim 35, further comprising:

parameter storage means for storing parameter sets representing said extension rates; and parameter selector means for selecting a parameter set used in the past from said parameter storage means.

37. A radio receiver according to claim 36, wherein said parameter selector means includes frequency detection means for detecting a parameter set used at a highest frequency from a plurality of the parameters.

* * * * *